US011376845B2

(12) United States Patent
Nakano

(10) Patent No.: US 11,376,845 B2
(45) Date of Patent: Jul. 5, 2022

(54) LIQUID EJECTING APPARATUS AND LIQUID EJECTING HEAD UNIT

(71) Applicant: SEIKO EPSON CORPORATION, Tokyo (JP)

(72) Inventor: Shuichi Nakano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/098,496

(22) Filed: Nov. 16, 2020

(65) Prior Publication Data

US 2021/0146683 A1 May 20, 2021

(30) Foreign Application Priority Data

Nov. 18, 2019 (JP) ..... JP2019-207673

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC ..... B41J 2/2135; B41J 19/202; B41J 19/207
See application file for complete search history.

(56) References Cited

U.S. PATENT DOCUMENTS 7,014,289 B1 * 3/2006 Matsuda ..... B41J 2/2135 347/19
2003/0234827 A1 * 12/2003 Tsuruoka ..... B41J 19/202 347/14
2006/0202646 A1 * 9/2006 Kojima ..... B65H 5/021 318/34
2011/0074856 A1 * 3/2011 Iesaki ..... B41J 11/0095 198/341.01

FOREIGN PATENT DOCUMENTS

JP 2002-356033 A 12/2002
JP 2003-175650 A 6/2003

* cited by examiner

*Primary Examiner* — Lam S Nguyen
(74) *Attorney, Agent, or Firm* — Global IP Counselors, LLP

(57) ABSTRACT

A liquid ejecting apparatus includes an ejecting section configured to eject liquid to a print medium, a movement mechanism configured to change the relative positional relationship between the print medium and the ejecting section, an encoder configured to include a scale, a light emitting element emitting light, and a light receiving element receiving light reflected by the scale or light transmitted through the scale in the emitted light and configured to output information changed in accordance with a change in the positional relationship, a signal generation section configured to generate a pulse signal including a pulse prescribing a timing when the ejecting section ejects liquid based on the information, a measurement section configured to measure a time length between pulses included in the pulse signal, and an ejection restriction section configured to restrict ejection of liquid from the ejecting section when the time length is larger than a threshold value.

14 Claims, 12 Drawing Sheets

LIQUID EJECTING APPARATUS AND LIQUID EJECTING HEAD UNIT

The present application is based on, and claims priority from JP Application Serial Number 2019-207673, filed Nov. 18, 2019, the disclosure of which is hereby incorporated by reference herein in its entirety.

BACKGROUND

1. Technical Field

The present disclosure related to a liquid ejecting apparatus and a liquid ejecting head unit.

2. Related Art

In general, liquid ejecting apparatuses ejecting liquid, such as ink, have been used as represented by ink jet printers. This type of apparatus, as disclosed in JP-A-2002-356033, ejects liquid to be landed on a print medium from a liquid ejecting head unit while the relative positional relationship between the liquid ejecting head unit ejecting liquid and the print medium is changed, for example.

The apparatus disclosed in JP-A-2002-356033 changes the relative positional relationship between a head and a print sheet by causing a carriage in which a head ejecting ink is fixed to reciprocate in a vertical direction relative to a sheet feeding direction. Here, ejection of ink from the head is controlled based on an output of an encoder for detecting a position of the carriage. The encoder has a scale, a light emitting element emitting light to the scale, and a light receiving element receiving light transmitted through the scale in the light emitted from the light emitting element.

In general, mist of liquid droplets floating in a housing of a liquid ejecting apparatus without being attached to a print medium is secondarily generated in addition to liquid droplets attached to the print medium when a liquid ejecting head unit ejects liquid to the print medium as liquid droplets. Such mist of liquid droplets causes a detection error of an encoder when being attached to a scale of the encoder.

In the apparatus disclosed in JP-A-2002-356033, even when an error occurs in detection performed by the encoder, a timing when liquid is to be ejected is controlled based on an output of the encoder of the erroneous detection without change. Therefore, there arises a problem in the apparatus disclosed in JP-A-2002-356033 in that printing is performed in a state in which image quality is degraded.

SUMMARY

According to an aspect of the present disclosure, a liquid ejecting apparatus includes an ejecting section configured to eject liquid to a print medium, a movement mechanism configured to change the relative positional relationship between the print medium and the ejecting section, an encoder configured to include a scale, a light emitting element emitting light to the scale, and a light receiving element receiving light reflected by the scale or light transmitted through the scale in the emitted light and configured to output information changed in accordance with a change in the positional relationship, a signal generation section configured to generate a pulse signal including a pulse prescribing a timing when the ejecting section ejects liquid based on the information, a measurement section configured to measure a time length between pulses included in the pulse signal, and an ejection restriction section configured to restrict ejection of liquid from the ejecting section when the time length is larger than a threshold value.

According to another aspect of the present disclosure, a liquid ejecting head unit mounted on a liquid ejecting apparatus including an ejecting section configured to eject liquid to a print medium, a movement mechanism configured to change the relative positional relationship between the print medium and the ejecting section, and an encoder configured to include a scale, a light emitting element emitting light to the scale, and a light receiving element receiving light reflected by the scale or light transmitted through the scale in the emitted light and configured to output information changed in accordance with a change in the positional relationship, includes the ejecting section, a signal generation section configured to generate a pulse signal including a pulse prescribing a timing when the ejecting section ejects liquid based on the information, a measurement section configured to measure a time length between pulses included in the pulse signal, and an ejection restriction section configured to restrict ejection of liquid from the ejecting section when the time length is larger than a threshold value.

DESCRIPTION OF EXEMPLARY EMBODIMENTS

Figure 1:
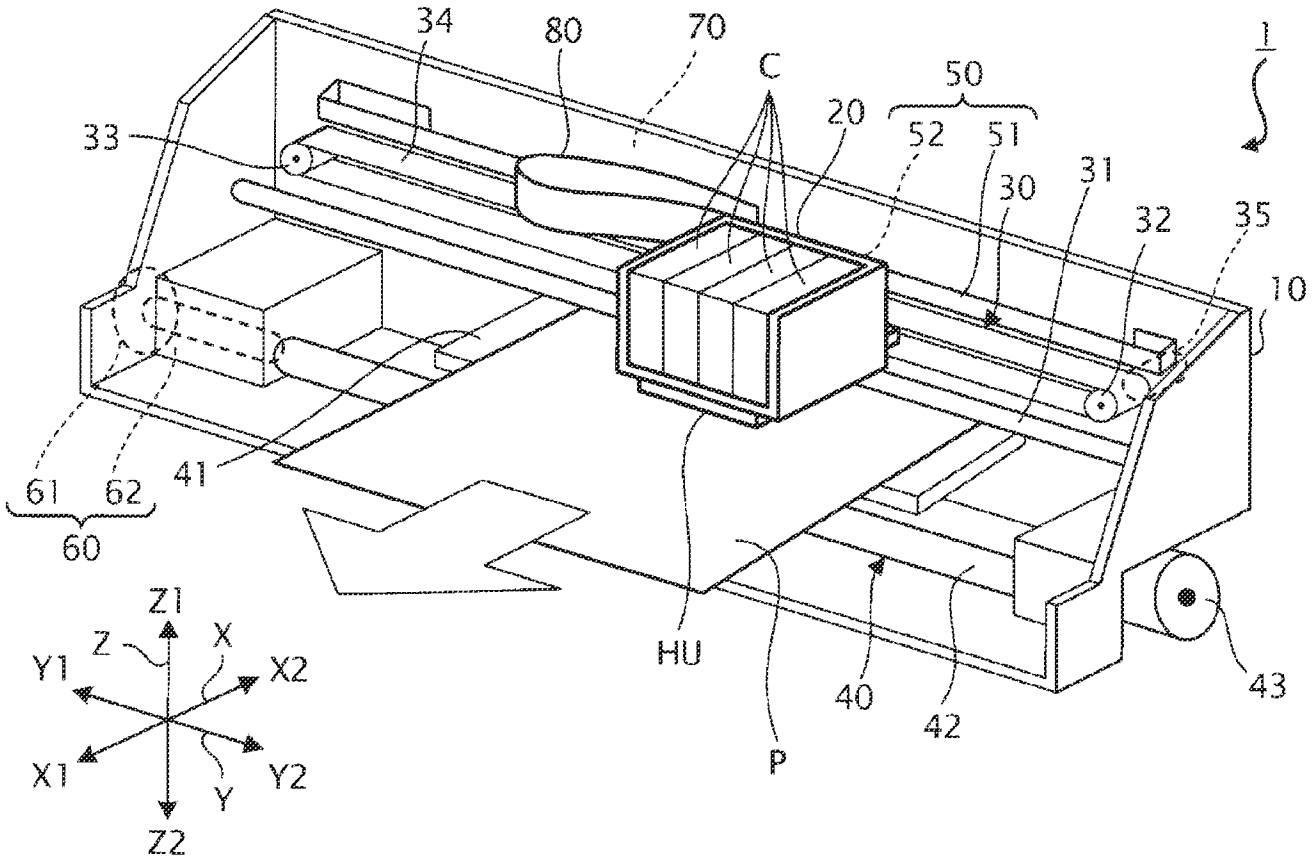
FIG. 1 is a perspective view schematically illustrating a configuration of a liquid ejecting apparatus according to a first embodiment.

Hereinafter, embodiments of the present disclosure will be described with reference to the accompanying drawings.

Note that, in the drawings, sizes and scales of the sections are different from actual sections where appropriate. Note that, although technically preferred restrictions are assigned to the embodiments described below since the embodiments are preferred concrete examples of the present disclosure, the scope of the present disclosure is not limited to the embodiments unless a description indicating that the present disclosure is restricted is made.

A1. First Embodiment

A1-1. Brief Description of Liquid Ejecting Apparatus 1

FIG. 1 is a perspective view schematically illustrating a configuration of a liquid ejecting apparatus 1 according to a first embodiment. The liquid ejecting apparatus 1 is an ink jet printer performing printing by ejecting ink which is an example of liquid to a print medium P as liquid droplets. Typical examples of the print medium P include a print sheet. Note that the print medium P is not limited to a print sheet and may be a print target of arbitrary material, such as a resin film or fabric.

In the example of FIG. 1, the liquid ejecting apparatus 1 is a serial printer. Specifically, the liquid ejecting apparatus 1 includes a housing 10, a carriage 20, a movement mechanism 30, a transport mechanism 40, encoders 50 and 60, and a control module 70.

In the liquid ejecting apparatus 1, print data is supplied to the control module 70 from a host computer which is an external apparatus, such as a personal computer or a digital still camera, not illustrated. Thereafter, under control of the control module 70, the transport mechanism 40 transports the print medium P in a sub-scanning direction, and in addition, a head unit HU mounted on the carriage 20 ejects ink toward the print medium P while the movement mechanism 30 causes the carriage 20 to reciprocate in a main scanning direction. Here, an image corresponding to the print data is printed on the print medium P when the control module 70 controls an operation of the head unit HU based on the print data. Furthermore, the encoder 50 detects an operation state of the movement mechanism 30, and in addition, the encoder 60 detects an operation state of the transport mechanism 40, so that the control module 70 controls the various sections included in the liquid ejecting apparatus 1 appropriately using results of the detections.

Hereinafter, first, configurations of the sections included in the liquid ejecting apparatus 1 are briefly described with reference to FIG. 1. Note that, for simplicity of description, X, Y, and Z axes which orthogonally intersect with one another are appropriately used in the description hereinafter. Furthermore, a direction along the X axis is referred to as an X1 direction and a direction opposite to the X1 direction is referred to as an X2 direction. Similarly, a direction along the Y axis is referred to as a Y1 direction and a direction opposite to the Y1 direction is referred to as a Y2 direction. A direction along the Z axis is referred to as a Z1 direction and a direction opposite to the Z1 direction is referred to as a Z2 direction. In this embodiment, at least one of the Y1 direction and the Y2 direction is the main scanning direction described above and the X1 direction is the sub-scanning direction described above. Note that it is not necessarily the case that the X, Y, and Z axes orthogonally intersect with one another but the X, Y, and Z axes at least intersect with one another within a range in which the operation of the liquid ejecting apparatus 1 is not adversely affected.

The housing 10 is a structure supporting the movement mechanism 30 and the transport mechanism 40. The housing 10 of this embodiment has a box shape accommodating the carriage 20, the movement mechanism 30, and the transport mechanism 40. Note that, in FIG. 1, a portion of the housing 10 is omitted for simplicity of the description. The housing 10 has a member covering the movement mechanism 30 and the transport mechanism 40, such as a lid, in practice, for example.

The movement mechanism 30 causes the carriage 20 to reciprocate in the Y1 direction and the Y2 direction relative to the housing 10. Accordingly, the movement mechanism 30 changes the relative positional relationship between the print medium P and ejecting sections D described below along the Y axis. Specifically, the movement mechanism 30 includes a guide shaft 31, a pair of pulleys 32 and 33, a timing belt 34, and a motor 35.

The guide shaft 31 is fixed on the housing 10, has a bar shape extending along the Y axis, and supports the carriage 20 so that the carriage 20 is movable along the Y axis. The pulley 32 is driven in a rotatable manner by the motor 35. The pulley 33 is rotated in accordance with driving force transmitted from the pulley 32 through the timing belt 34. The timing belt 34 having an endless shape extends along the guide shaft 31 and is hung on the pair of pulleys 32 and 33. The carriage 20 is fixed in a portion of the timing belt 34 in a circumferential direction.

In the movement mechanism 30 described above, when the rotation of the motor 35 is alternately switched between a normal direction and an opposite direction, the carriage 20 reciprocates in the Y1 and Y2 directions along the guide shaft 31 by the driving force transmitted from the motor 35 through the timing belt 34 to the carriage 20.

The transport mechanism 40 transports the print medium P in the X1 direction relative to the housing 10. Specifically, the transport mechanism 40 includes a platen 41, a transport roller 42, and a motor 43. The platen 41 is a board of a plate shape supporting the print medium P to which ink is applied from the head unit HU. The print medium P is supplied onto the platen 41 one by one by a sheet supply roller not illustrated. The transport roller 42 is driven by the motor 43 in a rotatable manner and transports the print medium P on the platen 41 in the X1 direction.

A position of the carriage 20 relative to the print medium P is changed in the direction along the X axis and the direction along the Y axis by the operation of the movement mechanism 30 and the transport mechanism 40 in combination described above. The head unit HU and a plurality of ink cartridges C are mounted on the carriage 20.

The encoder 50 is a transmission type linear encoder detecting a position of the carriage 20 in the Y1 direction or the Y2 direction. The encoder 50 includes a scale 51 and an optical sensor 52. The scale 51 and the optical sensor 52 will be described in detail hereinafter. However, when the scale 51 and the optical sensor 52 are briefly described here, the scale 51 is a member of a band shape disposed along the Y axis and is fixed on the housing 10. Although not illustrated in FIG. 1, the scale 51 has a base member having light transparency and a pattern of a light shielding property disposed on the base member by printing or the like. The pattern includes a plurality of light shielding sections arranged with a predetermined gap in a longitudinal direction of the scale 51. The optical sensor 52 is fixed on the carriage 20 and outputs a signal in accordance with a change in a position relative to the scale 51. Although not illustrated in FIG. 1, the optical sensor 52 includes a light emitting section including a light emitting element emitting light to the scale 51 and a light receiving section including a light receiving element receiving light transmitted through the scale 51 in the light emitted from the light emitting section. Note that the encoder 50 is not limited to the configuration illustrated in FIG. 1 as long as a position of the carriage 20 in the Y1 direction or the Y2 direction is detected, and may be a reflection type linear encoder, for example.

The encoder 60 is a transmission-type rotary encoder detecting a rotation angle of the transport roller 42. The encoder 60 includes a scale 61 and an optical sensor 62. The scale 61 is a circular disc member or a circular ring member fixed on the transport roller 42 and disposed in the same axis as the transport roller 42. Although not illustrated in FIG. 1, the scale 61 has a base member having light transparency and a pattern having a light shielding property disposed on the base member by printing or the like. The pattern includes a plurality of light shielding sections arranged with a predetermined gap in a circumferential direction of the scale 61. The optical sensor 62 is fixed on the housing 10 and outputs a signal in accordance with a change in a rotation angle of the scale 61. Although not illustrated in FIG. 1, the optical sensor 62 has the same configuration as the optical sensor 52 of the encoder 50 described above. Note that the encoder 60 is not limited to the configuration illustrated in FIG. 1 as long as a rotation angle of the transport roller 42 is detected and may be a reflection type rotary encoder, for example.

Each of the plurality of ink cartridges C accommodate ink to be supplied to the head unit HU. Different types of ink are accommodated in the different ink cartridges C. In the example of FIG. 1, the number of ink cartridges C is four, and different colors of ink are accommodated in the four different ink cartridges C. Examples of the colors of ink accommodated in the four ink cartridges C include four colors of cyan, magenta, yellow, and black. Furthermore, composition of the ink is not particularly limited, and water-based ink or solvent-based ink, for example, may be used. Note that the plurality of ink cartridges C may not be mounted on the carriage 20 but mounted on the housing 10. In this case, the ink may be supplied from the plurality of ink cartridges C through tubes to the head unit HU, for example. Furthermore, the number of ink cartridges C included in the head unit HU may be three or less or five or more.

The head unit HU ejects the ink from the plurality of ink cartridges C as liquid droplets to the print medium P. In the example illustrated in FIG. 1, the head unit HU ejects the four colors of ink after receiving supply of the four colors of ink from the four ink cartridges C described above.

The carriage 20 described above is electrically coupled to the control module 70 through a cable 80. In the example illustrated in FIG. 1, the cable 80 is a flexible flat cable. Note that the cable 80 is not limited to the flexible flat cable and may be a flexible wiring substrate, for example.

A1-2. Electrical Configuration of Liquid Ejecting Apparatus 1

Figure 2:
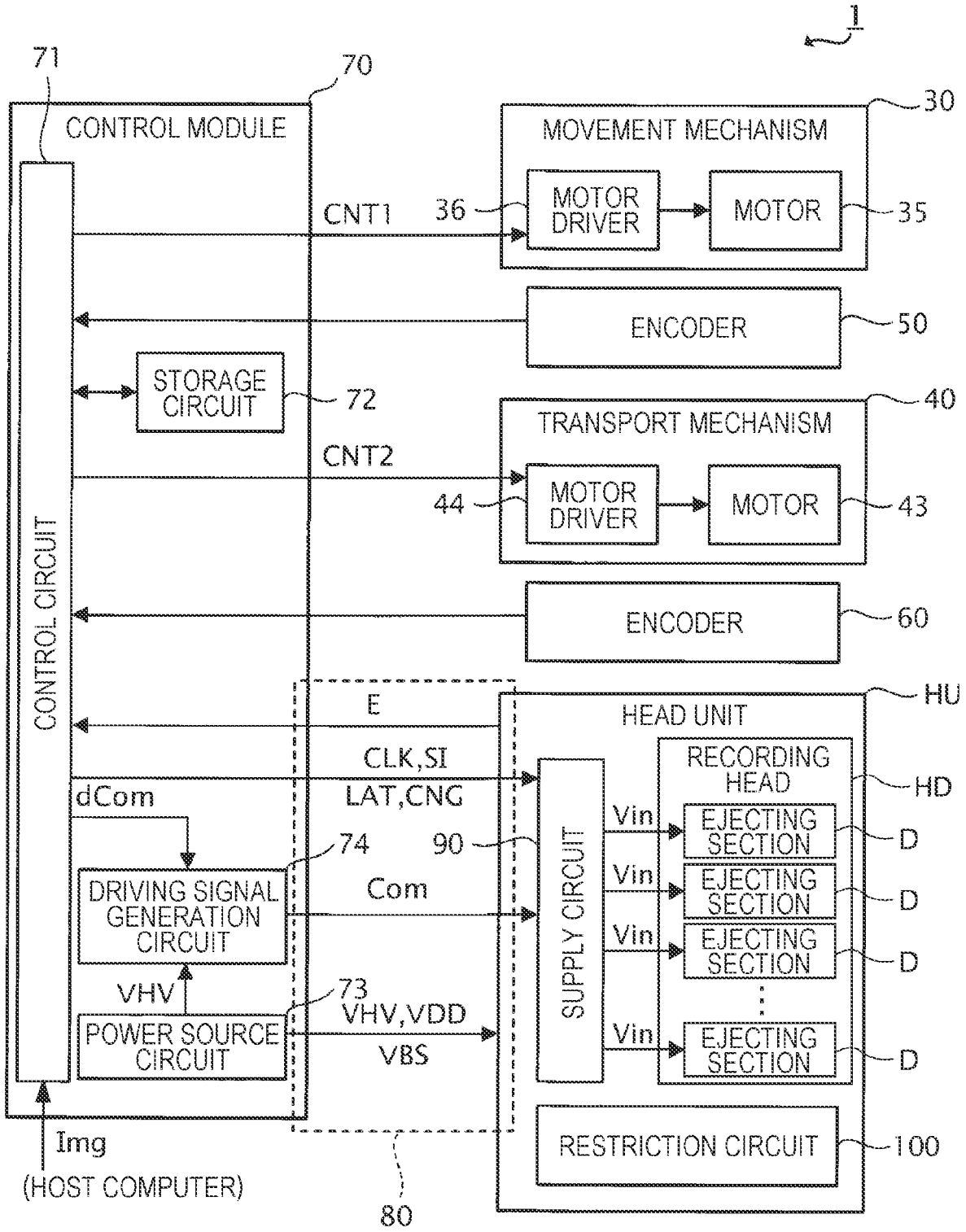
FIG. 2 is a block diagram illustrating an electrical configuration of the liquid ejecting apparatus according to the first embodiment.

FIG. 2 is a block diagram illustrating an electrical configuration of the liquid ejecting apparatus 1 according to the first embodiment. As illustrated in FIG. 2, the movement mechanism 30 includes, in addition to the components described above, a motor driver 36 driving the motor 35 described above. The transport mechanism 40 includes, in addition to the components described above, a motor driver 44 driving the motor 43 described above. Note that a portion of or all the motor driver 36 or the motor driver 44 may be included in the control module 70.

The head unit HU includes a recording head HD, a supply circuit 90, and a restriction circuit 100. The recording head HD includes the plurality of ejecting sections D ejecting ink to the print medium P. The supply circuit 90 supplies a supply driving signal Vin driving the ejecting sections D to at least selected one of the ejecting sections D. The restriction circuit 100 restricts ejection of ink from the recording head HD when a detection error of the encoder 50 is detected. The recording head HD, the cable 80, the supply circuit 90, and the restriction circuit 100 described above will be described in detail hereinafter.

Note that, although the number of recording heads HD included in the head unit HU is one in the example illustrated in FIG. 2, the number is not limited to this and the number of recording heads HD included in the head unit HU may be two or more. Furthermore, the number of ejecting sections D included in the recording head HD may be one. Hereinafter, assuming that the number of ejecting sections D included in the recording head HD is M, the ejecting sections D are referred to as ejecting sections D[m] using a subscript[m] where appropriate so that the M ejecting sections D are individually distinguished from one another. Note that M is a natural number equal to or larger than 1. Furthermore, the M other components or M signals of the liquid ejecting apparatus 1 have the correspondence relationship with the ejecting sections D[m] using the subscript [m] where appropriate.

The control module 70 individually controls driving of the movement mechanism 30, the transport mechanism 40, and the head unit HU described above. Specifically, the control module 70 includes a control circuit 71, a storage circuit 72, a power source circuit 73, and a driving signal generation circuit 74.

The control circuit 71 has a function of controlling operations of the various sections included in the liquid ejecting apparatus 1 and a function of processing various data. The control circuit 71 includes at least one processor, such as central processing unit (CPU). Note that the control circuit 71 may include a programmable logic device, such as a field-programmable gate array (FPGA) instead of the CPU or in addition to the CPU.

The storage circuit 72 stores various programs to be executed by the control circuit 71 and various data, such as print data Img, to be processed by the control circuit 71. The storage circuit 72 includes at least one of a semiconductor memory of a volatile memory, such as a random access memory (RAM), and a semiconductor memory of a non-volatile memory, such as a read only memory (ROM), an electrically erasable programmable read-only memory (EEPROM), or a programmable ROM (PROM). The print data Img is supplied from a host computer which is an external apparatus, such as a personal computer or a digital still camera, not illustrated.

The power source circuit 73 generates various predetermined potentials when receiving electric power supplied from a commercial power supply not illustrated. Specifically, the power source circuit 73 generates a power source potential VHV on a high potential side, a power source potential VDD on a low potential side, and an offset potential VBS. As setting values of these potentials, the offset potential VBS is approximately 6 V, the power source potential VHV is approximately 42 V, the power source potential VDD is approximately 3.3 V, and the offset potential VBS is approximately 6 V. These potentials are supplied to the head unit HU through the cable 80. Furthermore, the power source potential VHV is also supplied to the driving signal generation circuit 74. Note that, although not illustrated, a reference potential of 0 V which is a reference of the potentials described above is also supplied to the head unit HU through the cable 80.

The driving signal generation circuit 74 generates a driving signal Com used to drive the ejecting sections D. Specifically, the driving signal generation circuit 74 includes a DA conversion circuit and an amplification circuit, for example. In the driving signal generation circuit 74, the DA conversion circuit converts a digital waveform specifying signal dCom supplied from the control circuit 71 into an analog waveform specifying signal dCom and the amplification circuit amplifies the analog signal using the power source potential VHV supplied from the power source circuit 73 so that the driving signal Com is generated. Here, a signal having a waveform actually supplied to the ejecting sections D in waveforms included in the driving signal Com is the supply driving signal Vin described above. The waveform specifying signal dCom is a digital signal prescribing a waveform of the driving signal Com.

The control circuit 71 has a function of controlling the operations of the sections included in the liquid ejecting apparatus 1 by executing the programs stored in the storage circuit 72. Specifically, the control circuit 71 generates control signals CNT1 and CNT2, a print signal SI, the waveform specifying signal dCom, a clock signal CLK, a latch signal LAT, and a change signal CNG as signals for controlling operations of the sections included in the liquid ejecting apparatus 1 by executing the programs.

The control signal CNT1 controls driving of the movement mechanism 30. The control signal CNT1 is supplied to the motor driver 36 of the movement mechanism 30. The motor driver 36 drives the motor 35 in accordance with the control signal CNT1.

The control signal CNT2 controls driving of the transport mechanism 40. The control signal CNT2 is supplied to the motor driver 44 of the transport mechanism 40. The motor driver 44 drives the motor 43 in response to the control signal CNT2.

The print signal SI is a digital signal specifying a type of an operation of the ejecting sections D. Specifically, the print signal SI specifies whether the driving signal Com is to be supplied to the ejecting sections D so as to specify a type of operation of the ejecting sections D. Here, "to specify a type of operation of the ejecting sections D" means to specify whether the ejecting sections D are to be driven, to specify whether ink is to be ejected from the ejecting sections D when the ejecting sections D are driven, or to specify an amount of ink to be ejected from the ejecting sections D when the ejecting sections D are driven.

The latch signal LAT and the change signal CNG are used with the print signal SI and prescribe a timing when the ink is ejected from the ejecting sections D. Timings of pulses included in the signals are set as a timing synchronized with an operation of the carriage 20 based on an output of the encoder 50 described above, for example. Accordingly, the control circuit 71 is a signal generation section generating a pulse signal including a pulse prescribing the timing when ink is ejected from the ejecting sections D based on information supplied from the encoder 50. Note that the relationship between an output of the encoder 50 and the latch signal LAT will be described in detail hereinafter.

A1-3. Detailed Description of Encoder 50

Figure 3:
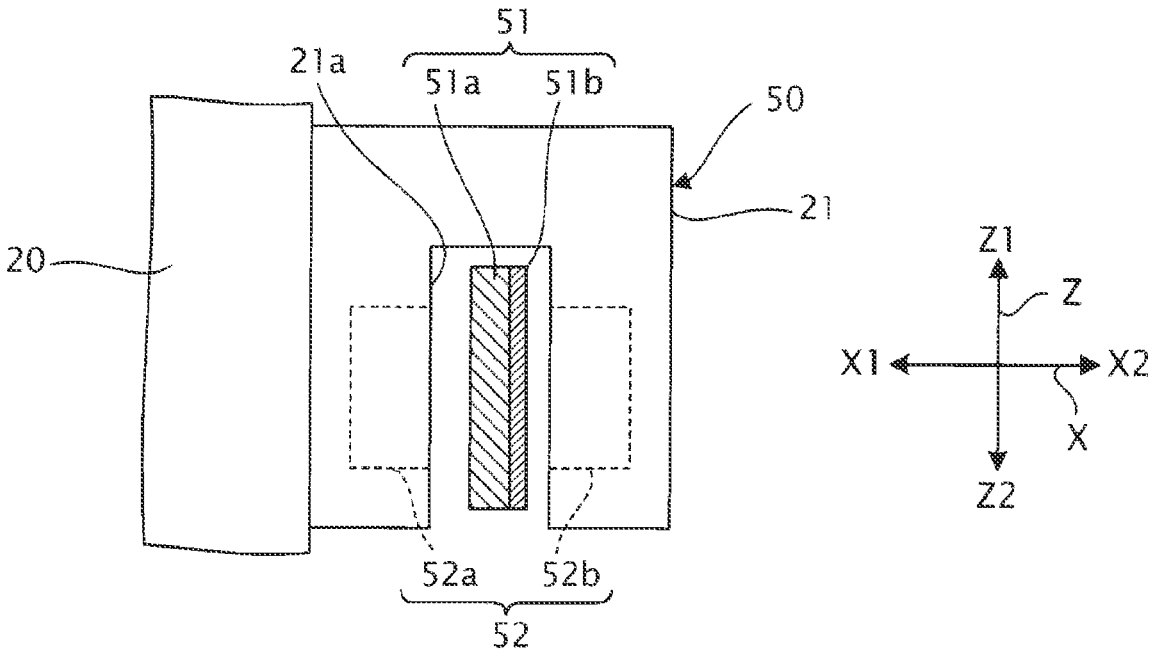
FIG. 3 is a diagram illustrating an encoder viewed in a Y2 direction.

FIG. 3 is a diagram illustrating the encoder 50 viewed in the Y2 direction. As described above, the encoder 50 includes the scale 51 and the optical sensor 52. As described above, while the scale 51 is fixed on the housing 10, the optical sensor 52 is fixed on the carriage 20. A support section 21 supporting the optical sensor 52 is disposed on the carriage 20 of this embodiment as illustrated in FIG. 3. For example, the support section 21 is formed with the carriage 20 in an integrated manner. A slit 21*a* to which the scale 51 is inserted is formed in the support section 21. The slit 21*a* is opened in opposite directions, that is, the Y1 and Y2 directions. Therefore, the scale 51 may be inserted in the slit 21*a*. Furthermore, the slit 21*a* is opened in the Z2 direction. Therefore, the scale 51 may be more easily inserted in the slit 21*a* when compared with a state in which the slit 21*a* is opened only in the Y1 and Y2 directions. Note that a configuration of the support section 21, such as a position or a configuration, in the carriage 20 is determined in accordance with a position where the encoder 50 is installed or the like, and is arbitrarily determined without being limited to the configuration illustrated in FIG. 3.

The scale 51 includes a long base member 51*a* having light transparency and a pattern 51*b* which is configured by a plurality of light shielding sections arranged with a predetermined gap in a longitudinal direction of the base member 51*a* and which has a light shielding property. The base member 51*a* is configured by resin material, such as polyethylene terephthalate (PET), for example. The pattern 51*b* is disposed on the base member 51*a* by printing or the like and is formed by ink having a light shielding property. The gap among the plurality of light shielding sections forming the pattern 51*b* is not limited and is appropriately determined in accordance with resolution or the like required for the liquid ejecting apparatus 1.

The optical sensor 52 includes a light emitting section 52*a* emitting light to the scale 51 and a light receiving section 52*b* receiving light emitted from the light emitting section 52*a* and transmitted through the scale 51. The scale 51 is interposed between the light emitting section 52*a* and the light receiving section 52*b*. In the example of FIG. 3, the light emitting section 52*a* is disposed in the X1 direction and the light receiving section 52*b* is disposed in the X2 direction relative to the scale 51. Note that the light emitting section 52*a* may be disposed in the X2 direction and the light receiving section 52*b* may be disposed in the X1 direction relative to the scale 51.

Figure 4:
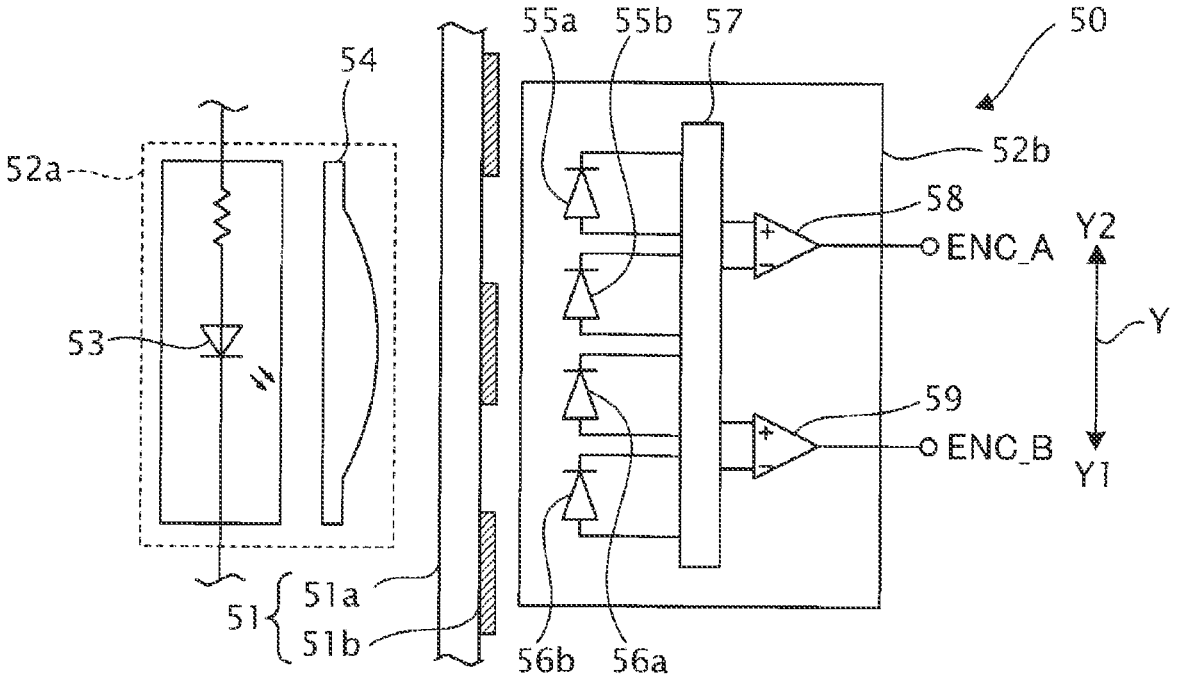
FIG. 4 is a diagram schematically illustrating a configuration of the encoder.

FIG. 4 is a diagram schematically illustrating a configuration of the encoder 50. The light emitting section 52*a* includes a light emitting element 53 and a lens 54. The light emitting element 53 is a light emitting diode, for example. The lens 54 is a collimated lens, for example, used to change light from the light emitting element 53 to parallel light. Light from the light emitting element 53 is incident on the scale 51 through the lens 54.

The light receiving section 52*b* includes light receiving elements 55*a*, 55*b*, 56*a*, and 56*b*, an amplification circuit 57, and comparators 58 and 59. Each of the light receiving elements 55*a*, 55*b*, 56*a*, and 56*b* is a photo transistor, a photo diode, or a photo integrated circuit (IC), for example. The light receiving elements 55*a* and 55*b* are arranged in parallel along the Y axis with a center-to-center distance of half a pitch of the pattern 51*b* described above interposed therebetween. Similarly, the light receiving elements 56*a* and 56*b* are arranged in parallel along the Y axis with a center-to-center distance of half the pitch of the pattern 51*b* described above interposed therebetween. Note that the light receiving elements 56*a* and 56*b* are disposed with a distance sift corresponding to a quarter of the pitch of the pattern 51*b* described above along the Y axis relative to the light receiving elements 55*a* and 55*b*. Note that, in FIG. 4, the light receiving elements 55*a*, 55*b*, 56*a*, and 56*b* are arranged in an equal interval for simplicity of description.

The amplification circuit 57 amplifies analog signals supplied from the light receiving elements 55*a*, 55*b*, 56*a*, and 56*b*. The analog signals are supplied from the light receiving elements 55*a* and 55*b* to the comparator 58 through the amplification circuit 57. The comparator 58 compares magnitudes of the analog signals and outputs a signal ENC_A of a high level or a low level in accordance with a result of the comparison. Similarly, the analog signals are supplied from the light receiving elements 56*a* and 56*b* to the comparator 59 through the amplification circuit 57. The comparator 59 compares magnitudes of the analog signals and outputs a signal ENC_B of a high level or a low level in accordance with a result of the comparison.

Figure 5:
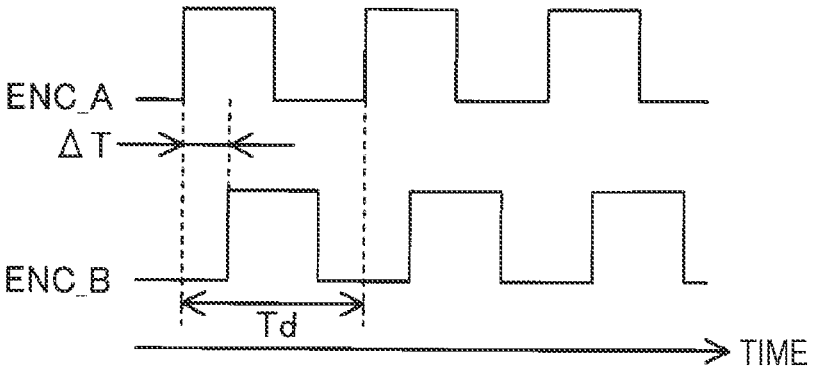
FIG. 5 is a diagram illustrating signals output from the encoder.

FIG. 5 is a diagram illustrating the signals ENC_A and ENC_B output from the encoder 50. As illustrated in FIG. 5, a pulse time interval Td is common to the signal ENC_A and the signal ENC_B. However, a phase of the signal ENC_A and a phase of the signal ENC_B is shifted by 90 degrees as a shift amount ΔT. Here, a direction of the shift between the phases of the signals ENC_A and ENC_B varies depending on a movement direction of the optical sensor 52 relative to the scale 51. Therefore, a movement direction of the optical sensor 52 relative to the scale 51 may be identified based on the direction.

As described above, the encoder 50 includes the scale 51, the light emitting element 53, and the light receiving elements 55*a*, 55*b*, 56*a*, and 56*b*. Here, the light emitting element 53 emits light to the scale 51. The light receiving elements 55*a*, 55*b*, 56*a*, and 56*b* receive light transmitted through the scale 51 in the emitted light. Consequently, the light receiving elements 55*a*, 55*b*, 56*a*, and 56*b* output the signals ENC_A and ENC_B as information changed in accordance with a change in the relative positional relationship between the print medium P and the ejecting sections D described below in the Y1 direction or the Y2 direction. Note that, when the encoder 50 is a reflection type encoder, the light receiving elements 55*a*, 55*b*, 56*a*, and 56*b* receive light reflected by the scale 51 in the light emitted by the light emitting element 53.

A1-4. Schematic Configuration of Ejecting Sections D

Figure 6:
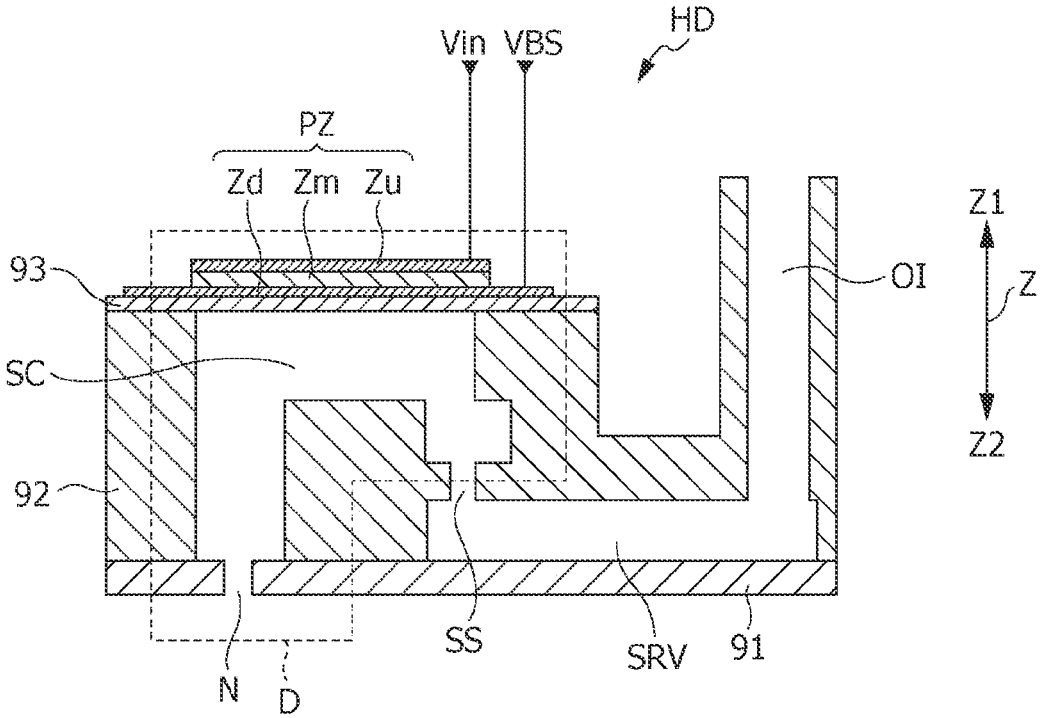
FIG. 6 is a cross-sectional view schematically illustrating a configuration of a recording head including an ejecting section.

FIG. 6 is a cross-sectional view schematically illustrating a configuration of the recording head HD including the ejecting sections D. As illustrated in FIG. 6, the recording head HD includes a nozzle plate 91, a flow path substrate 92, a vibration plate 93, and a plurality of piezoelectric elements PZ. The nozzle plate 91, the flow path substrate 92, the vibration plate 93, and the plurality of piezoelectric elements PZ are laminated in this order.

A plurality of nozzles N arranged in a predetermined direction are formed on the nozzle plate 91. Each of the nozzles N is a through hole through which the ink passes. A plurality of cavities SC, a reservoir SRV, a plurality of ink supply paths SS, and an ink inlet OI are formed in the flow path substrate 92. The cavities SC are disposed for individual nozzles N and are spaces communicated with the nozzles N. The reservoir SRV is disposed in common to the plurality of nozzles N and extends in a direction in which the plurality of nozzles N are arranged. The plurality of ink supply paths SS are disposed for individual nozzles N and are spaces causing the plurality of cavities SC and the reservoir SRV to communicate with each other. The ink inlet OI is an opening used to guide the ink from the ink cartridges C to the reservoir SRV. The vibration plate 93 constitutes portions of wall surfaces of the plurality of cavities SC and is a plate-like member which may be elastically deformed in a direction in which volume of the cavities SC is changed for individual cavities SC.

In the example illustrated in FIG. 6, each of the plurality of piezoelectric elements PZ is a unimorph (monomorph) type piezoelectric element. Specifically, each of the plurality of piezoelectric elements PZ includes an upper electrode Zu, a piezoelectric body Zm, and a lower electrode Zd. These are laminated in this order from the top. An offset potential VBS is supplied from the power source circuit 73 described above to the lower electrode Zd. A supply driving signal Vin including a portion of or all the waveform of the driving signal Com supplied from the driving signal generation circuit 74 described above is supplied to the upper electrode Zu. When a voltage based on a potential difference between the offset potential VBS and the supply driving signal Vin is applied to a portion between the upper electrode Zu and the lower electrode Zd, the piezoelectric elements PZ vibrates the vibration plate 93 in the Z1 direction or the Z2 direction by an inverse piezoelectric effect of the piezoelectric body Zm. The ink is ejected from the nozzles N when pressure of the cavities SC is changed along with a change in the volume of the cavities SC by the vibration. Note that the configuration of the piezoelectric elements PZ is not limited to a unimorph type described above and may be a bimorph type or a laminated type, for example.

In the components of the recording head HD described above, an aggregate of the components disposed for each nozzle N is the ejecting section D. Here, the ejecting section D includes the cavity SC, the piezoelectric element PZ, and the nozzle N.

A1-5. Electrical Configuration of Head Unit HU

Figure 7:
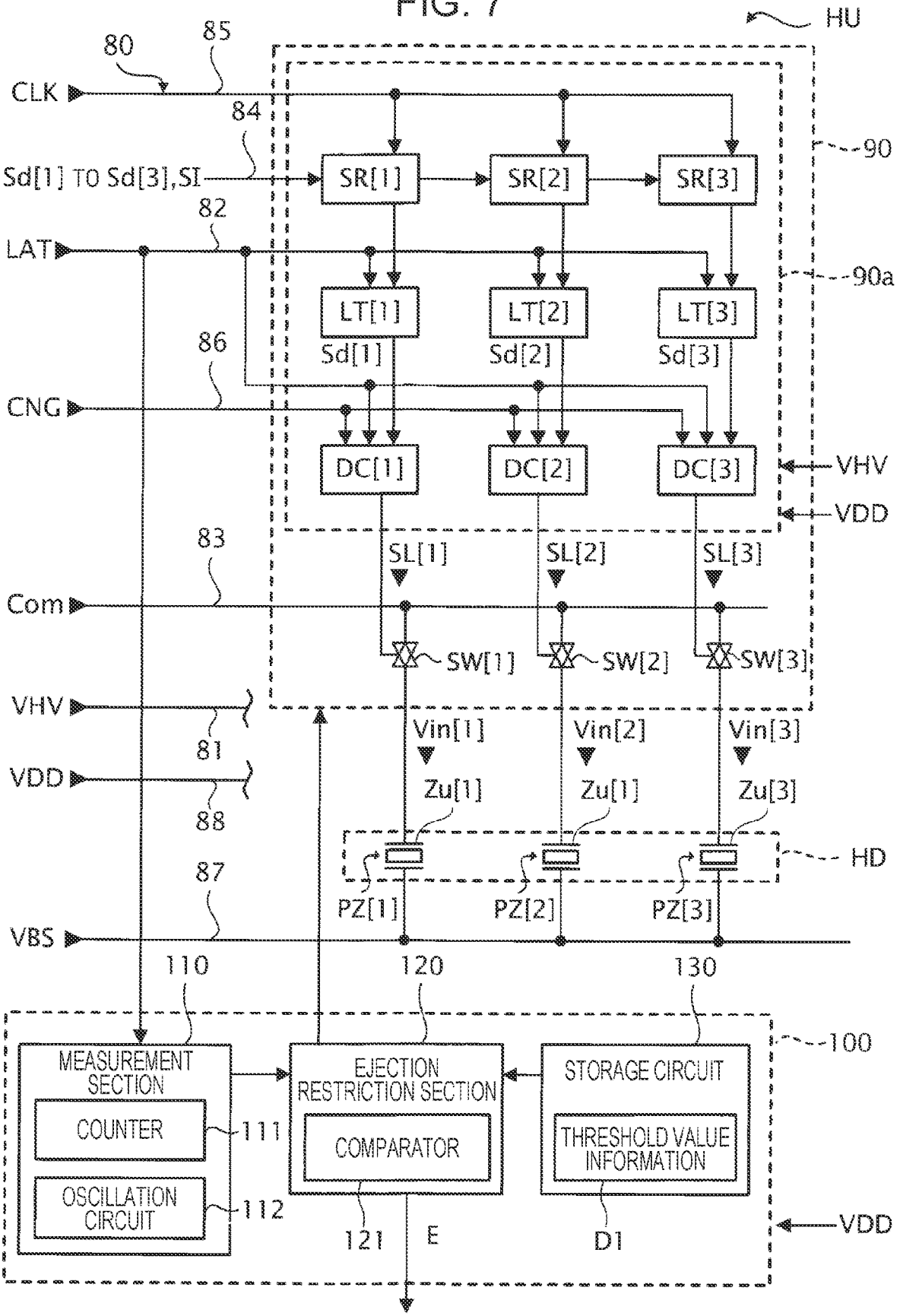
FIG. 7 is a diagram illustrating an electrical configuration of a liquid ejecting head unit.

FIG. 7 is a diagram illustrating an electrical configuration of the head unit HU. Although described above, as illustrated in FIG. 7, the head unit HU is coupled to the cable 80, and the head unit HU includes the recording head HD, the supply circuit 90, and the restriction circuit 100.

The cable 80 includes a plurality of lines 81 to 88. The line 81 is a power supply line on a high potential side supplying the power source potential VHV which is a fixed potential. The power source potential VHV is used to drive the ejecting sections D. The line 82 is a signal line transmitting a LAT signal which is an example of a pulse signal prescribing a timing when the ink is ejected from the ejecting sections D. The line 83 is a signal line transmitting a driving signal Com. The line 84 is a signal line transmitting a print signal SI. The line 85 is a signal line transmitting a clock signal CLK. The line 86 is a signal line transmitting a change signal CNG. The line 87 is a power supply line supplying the offset potential VBS. The line 88 is a power supply line on a low potential side supplying the power source potential VDD. The power source potential VDD is used to drive various logic circuits included in the head unit HU. Although not illustrated, in addition to the lines described above, a line of a ground potential of 0 V used as a reference potential is included in the cable 80.

The supply circuit 90 includes M switches SW (SW[1] to SW[M]) and a connection state specifying circuit 90*a* specifying connection states of the switches SW. In FIG. 7, M is 3 for simplicity of description.

A switch SW[m] performs switching between a conductive (ON) state and a non-conductive (OFF) state in a portion between the line 83 and a piezoelectric element PZ[m] in a transmission path of the driving signal Com from the driving signal generation circuit 74 to the piezoelectric element PZ[m]. Each of the switches SW is a transmission gate, for example.

The connection state specifying circuit 90*a* generates connection state specifying signals SL[1] to SL[M] specifying an ON or OFF state of the switches SW[1] to SW[M] based on the clock signal CLK, the print signal SI, the latch signal LAT, and the change signal CNG supplied from the control circuit 71.

Specifically, the connection state specifying circuit 90*a* includes transfer circuits SR[1] to SR[M], latch circuits LT[1] to LT[M], and decoders DC[1] to DC[M] which correspond to the ejecting sections D[1] to D[M], respectively. Among these, the print signal SI is supplied to a transfer circuit SR[m] through the line 84. Here, the print signal SI includes a discrete specifying signal Sd[m] described below. In the example of FIG. 7, the discrete specifying signals Sd[1] to Sd[M] are serially supplied, and for example, the discrete specifying signals Sd[m] are successively transferred to the transfer circuits SR[1] to SR[M] in synchronization with the clock signal CLK supplied from the line 85. Furthermore, a latch circuit LT[m] latches the discrete specifying signal Sd[m] supplied to the transfer circuit SR[m] at a timing when a pulse PlsL of the latch signal LAT supplied from the line 82 is brought into a high level. Furthermore, the decoder DC[m] generates a connection state specifying signal SL[m] based on the discrete specifying signal Sd[m], the latch signal LAT, and the change signal CNG. Here, when the decoder DC[m] generates the connection state specifying signal SL[m], the power source potential VHV is also used.

The ON state or the OFF state of the switch SW[m] is switched in accordance with the connection state specifying signal SL[m] generated as described above. For example, the switch SW[m] is turned on when the connection state specifying signal SL[m] is in a high level and turned off when the connection state specifying signal SL[m] is in a low level. As described above, the supply circuit 90 supplies a portion of or all the waveform included in the driving signal Com to at least selected one of the ejecting sections D as a supply driving signal Vin.

The restriction circuit 100 restricts ejection of the ink in the recording head HD when a detection error occurs in the encoder 50. Specifically, the restriction circuit 100 includes a measurement section 110, an ejection restriction section 120, and a storage circuit 130.

The measurement section 110 is a circuit measuring a time length t between pulses in the latch signal LAT. Specifically, the measurement section 110 includes a counter 111 and an oscillation circuit 112. The counter 111 counts the number of pulses of a clock signal supplied from the oscillation circuit 112 for each period between pulses of the latch signal LAT. For example, the counter 111 repeatedly performs an operation of starting counting of a clock signal supplied from the oscillation circuit 112 when a pulse of the latch signal LAT falls and stopping the count when a next pulse of the latch signal LAT rises. Here, the counter 111 outputs a count value as information corresponding to the time length t between pulses of the latch signal LAT every time the counter is stopped. The oscillation circuit 112 outputs a clock signal using a crystal oscillator, for example. A clock frequency of the clock signal is not particularly limited and is arbitrarily determined as long as the time length t between pulses of the latch signal LAT is measured.

Note that the counter 111 may start the counting when a pulse of the latch signal LAT rises or stop the counting when a pulse of the latch signal LAT falls. Furthermore, the counter 111 may reset a count value every time the counting is started.

The ejection restriction section 120 restricts ejection of the ink from the ejecting sections D when the time length t which is a result of the measurement performed by the measurement section 110 is longer than a threshold value Tth. Specifically, the ejection restriction section 120 includes a comparator 121 comparing the time length t with the threshold value Tth. The ejection restriction section 120 restricts an operation of ejecting ink performed by the ejecting sections D based on a result of the comparison performed by the comparator 121. For example, the ejection restriction section 120 stops an operation of the connection state specifying circuit 90*a* described above so that the switch SW[m] is maintained in the OFF state when the time length t is larger than the threshold value Tth. Note that the ejection restriction section 120 may include a programmable logic device, such as a FPGA.

When ejection of ink from the ejecting sections D is to be restricted, the ejection restriction section 120 outputs information E associated with the ejection to an outside. The information E is input to the control circuit 71, for example. The control circuit 71 notifies a user of the information associated with the restriction using a display device or a sound generation device, not illustrated, for example, based on the information E.

The storage circuit 130 stores information required for operations of the ejection restriction section 120. The storage circuit 130 includes a semiconductor memory, for example. The storage circuit 130 of this embodiment stores threshold value information D1. The threshold value information D1 is associated with the threshold value Tth which is a reference for determining whether a detection error has occurred in the encoder 50. The threshold value Tth is set as a value within a range from a normal value of a length of a unit period Tu described below to a value smaller than twice the normal value, for example. Note that a portion of or all the storage circuit 130 may be included in the ejection restriction section 120.

A1-6. Operation of Head Unit HU

Figure 8:
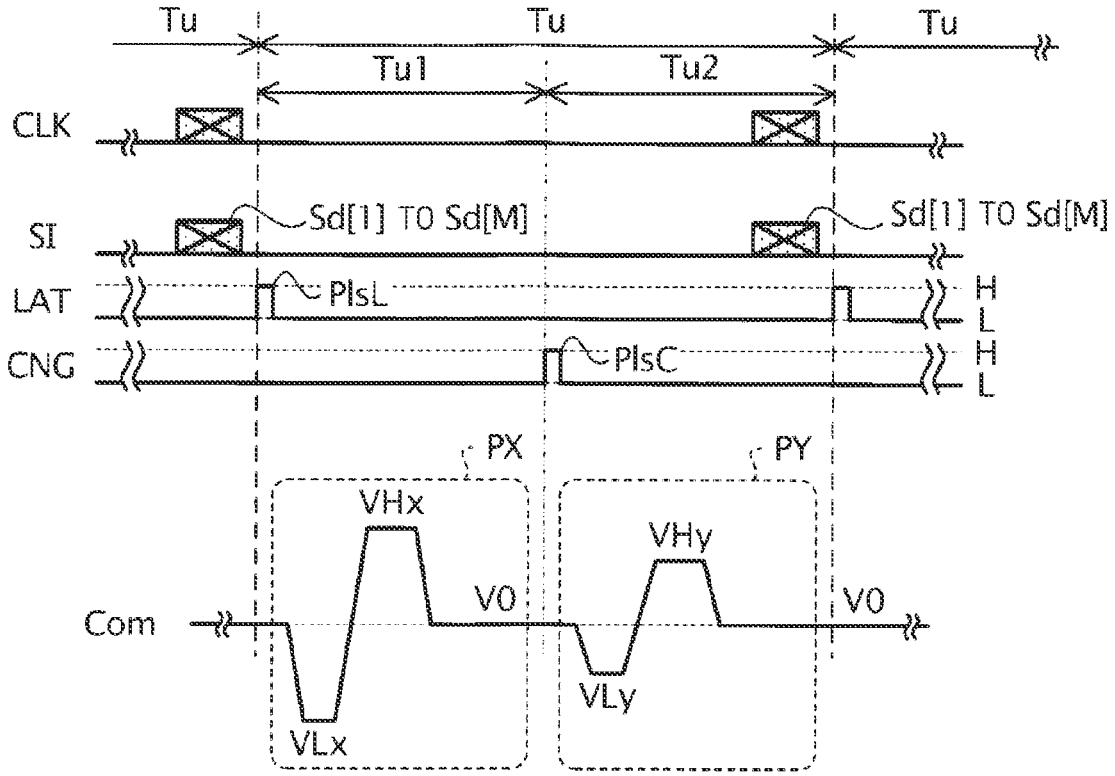
FIG. 8 is a timing chart illustrating an example of an operation of the liquid ejecting head unit.

FIG. 8 is a timing chart of an example of an operation of the head unit HU. As illustrated in FIG. 8, the latch signal LAT includes a pulse PlsL for prescribing the unit period Tu. The unit period Tu is prescribed as a period from when a pulse PlsL rises to when a next pulse PlsL rises, for example. Furthermore, the change signal CNG includes a pulse PlsC for dividing the unit period Tu into a control period Tu1 and a control period Tu2. The control period Tu1 is a period from when the pulse PlsL rises to when the pulse PlsC rises. The control period Tu2 is a period from when the pulse PlsC rises to when the pulse PlsL rises.

Furthermore, the print signal SI includes discrete specifying signals Sd[1] to Sd[M] specifying types of operation of the ejecting sections D[1] to D[M] for each unit period Tu. The discrete specifying signals Sd[1] to Sd[M] are supplied to the connection state specifying circuit 90*a* in synchronization with the clock signal CLK as described above before the unit period Tu. The connection state specifying circuit 90*a* generates a connection state specifying signal SL[m] based on the discrete specifying signal Sd[m] in the unit period Tu.

As illustrated in FIG. 8, the driving signal Com has a waveform PX formed in the control period Tu1 and a waveform PY formed in the control period Tu2. In the example of FIG. 8, a potential difference between a highest potential VHx and a lowest potential VLx in the waveform PX is larger than a potential difference between a highest potential VHy and a lowest potential VLy in the waveform PY.

When the discrete specifying signal Sd[m] is a value specifying formation of a middle dot, the connection state specifying signal SL[m] is brought into a high level in the control period Tu1 and a low level in the control period Tu2. Therefore, only the waveform PX in the driving signal Com is supplied to the ejecting sections D as a supply driving signal Vin. Consequently, an amount of ink corresponding to the middle dot is ejected from the ejecting sections D.

When the discrete specifying signal Sd[m] has a value specifying formation of a small dot, the connection state specifying signal SL[m] is brought into a low level in the control period Tu1 and a high level in the control period Tu2. Therefore, only the waveform PY in the driving signal Com is supplied to the ejecting sections D as a supply driving signal Vin. Consequently, an amount of ink corresponding to the small dot is ejected from the ejecting sections D.

When the discrete specifying signal Sd[m] has a value specifying formation of a large dot, the connection state specifying signal SL[m] is brought into a high level in both the control periods Tu1 and Tu2. Therefore, the waveforms PX and PY in the driving signal Com are supplied to the ejecting sections D as a supply driving signal Vin. Consequently, an amount of ink corresponding to the large dot is ejected from the ejecting sections D.

When the discrete specifying signal Sd[m] has a value specifying non-ejection of ink, the connection state specifying signal SL[m] is brought into a low level in the control periods Tu1 and Tu2. Therefore, the waveforms PX and PY in the driving signal Com are not supplied to the ejecting sections D. Consequently, ink is not ejected from the ejecting sections D.

A1-7. Operation of Ejection Restriction Section 120

Figure 9:
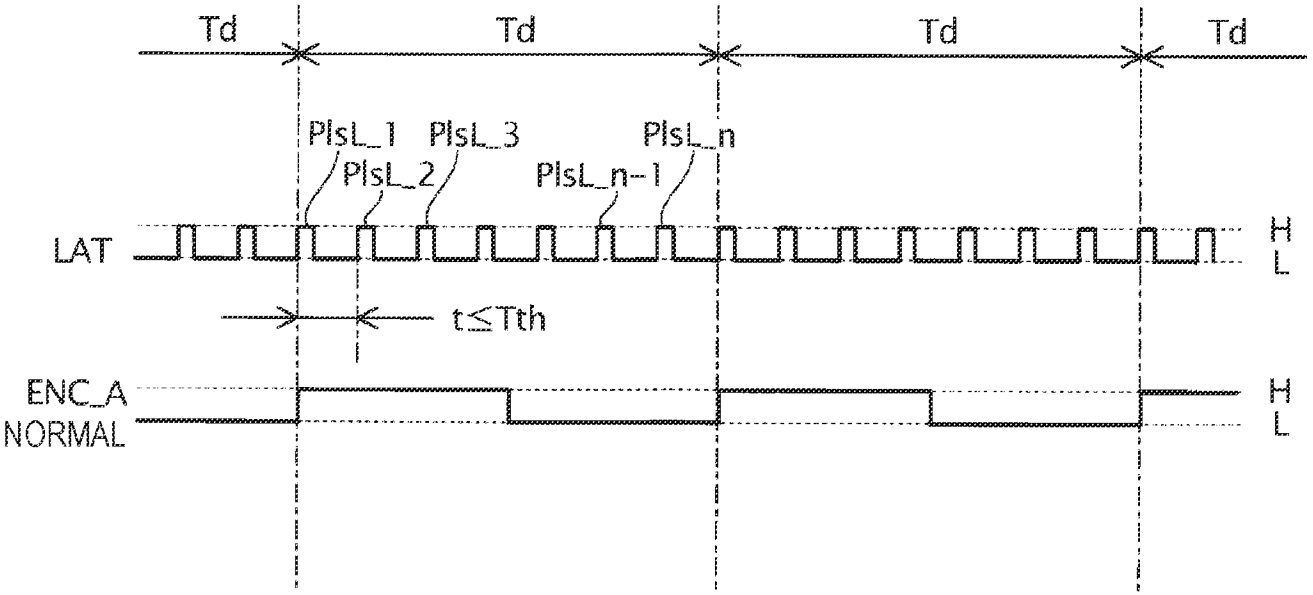
FIG. 9 is a diagram illustrating a time length between pulses of a latch signal obtained when detection performed by the encoder is normal.

FIG. 9 is a diagram illustrating a time length t between pulses of the latch signal LAT obtained when detection performed by the encoder 50 is normal. In this case, the time length t is equal to or smaller than the threshold value Tth and is within a normal range of a length of the unit period Tu described above. Here, the time length t is prescribed based on information from the encoder 50 described above. Specifically, the control circuit 71 described above calculates the time length t in accordance with a pulse time interval Td of the signal ENC_A supplied from the encoder 50. Then the control circuit 71 generates the latch signal LAT including the pulse PlsL generated every time length t.

In FIG. 9, n pulses PlsL are included in the pulse time interval Td of the signal ENC_A supplied from the encoder 50, for example. Note that n is a natural number equal to or larger than 1. In the example of FIG. 9, n is 7. In FIG. 9, n pulses PlsL are indicated by pulses PlsL_1 to PlsL_n. Note that n is not limited to the example of FIG. 9, and is preferably within a range equal to or larger than 1 and equal to or smaller than 20. More preferably, n is within a range equal to or larger than 5 to equal to or smaller than 10.

As described above, the signal ENC_A is generated based on a result of reception of light transmitted through the scale 51 in the light emitted from the light emitting element 53 using the light receiving elements 55*a*, 55*b*, 56*a*, and 56*b*. On the other hand, in the liquid ejecting apparatus 1, mist of ink floating in the housing 10 of the liquid ejecting apparatus 1 without being attached to the print medium P is secondarily generated in addition to ink attached to the print medium P when the ejecting sections D eject ink. Such mist of ink attached to the scale 51 causes a detection error of the encoder 50. When a detection error occurs in the encoder 50, the time length t described above is changed.

Figure 10:
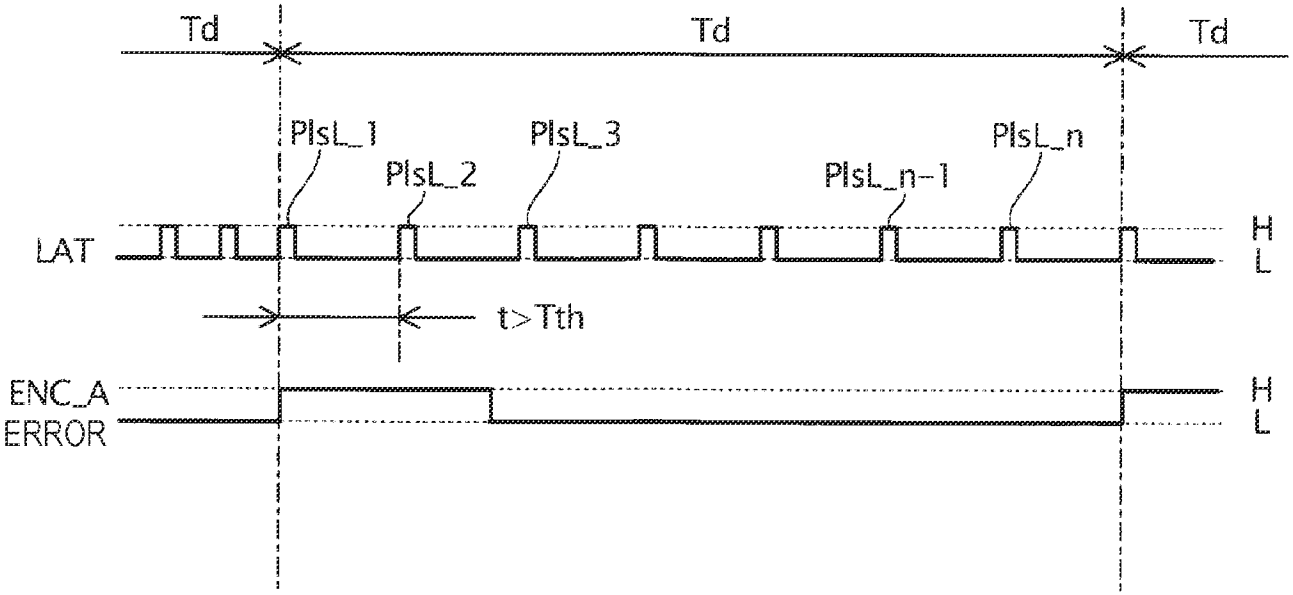
FIG. 10 is a diagram illustrating a time length between pulses of a latch signal obtained when an error occurs in detection performed by the encoder.

FIG. 10 is a diagram illustrating a time length t between pulses of the latch signal LAT obtained when an error occurs in detection performed by the encoder 50. In this case, the time length t is longer than the threshold value Tth and is out of a normal range of the length of the unit period Tu described above. When the time length t is changed in this way, image quality may be deteriorated. Then the ejection restriction section 120 restricts ejection of ink from the ejecting sections D when the time length t is larger than the threshold value Tth.

Note that a detection error in the encoder 50 may be detected by determining whether a pulse time interval Td of the signal ENCA supplied from the encoder 50 is larger than a predetermined threshold value. However, in this case, when the determination is performed by the head unit HU, a line used to transmit the signal ENC_A is required to be disposed in the cable 80. On the other hand, in the configuration of this embodiment in which a detection error of the encoder 50 is detected based on the time length t between pulses in the latch signal LAT, it is advantageous in that the line is not required to be disposed.

Figure 11:
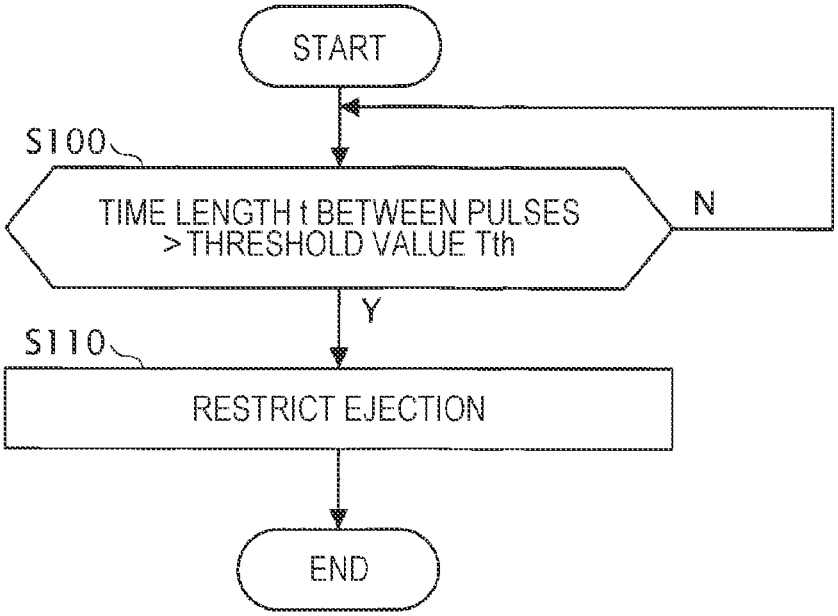
FIG. 11 is a flowchart of an operation performed by an ejection restriction section.

FIG. 11 is a flowchart of an operation performed by the ejection restriction section 120. As illustrated in FIG. 11, first, in step S100, the ejection restriction section 120 determines whether the time length t is larger than the threshold value Tth. The process in step S100 is repeatedly performed until the time length t becomes larger than the threshold value Tth.

When the time length t is larger than the threshold value Tth, the ejection restriction section 120 restricts the ink ejection operation performed by the ejecting sections D in step S110.

The liquid ejecting apparatus 1 described above includes the ejecting sections D, the movement mechanism 30, the encoder 50, the control circuit 71 which is an example of a signal generation section, the measurement section 110, and the ejection restriction section 120 as described above. Here, the liquid ejecting apparatus 1 has the head unit HU which is an example of a liquid ejecting head unit mounted on the liquid ejecting apparatus 1. The head unit HU includes the ejecting sections D, the control circuit 71, the measurement section 110, and the ejection restriction section 120.

The ejecting sections D eject ink which is an example of liquid to the print medium P. The movement mechanism 30 changes the relative positional relationship between the print medium P and the ejecting sections D. The encoder 50 includes the scale 51, the light emitting element 53, and the light receiving elements 55*a* and 55*b*. The light emitting element 53 emits light to the scale 51. The light receiving elements 55*a* and 55*b* receive light transmitted through the scale 51 in the emitted light and outputs the signal ENC_A as information changed in accordance with a change in the positional relationship. The control circuit 71 generates the latch signal LAT which is a pulse signal including the pulse PlsL prescribing the timing when the ejecting sections D eject ink based on the signal ENC_A. The measurement section 110 measures the time length t between pulses of the latch signal LAT. The ejection restriction section 120 restricts ejection of ink from the ejecting sections D when the time length t is larger than the threshold value Tth.

Here, when an amount of contamination of the mist of ink or the like attached to the scale 51 of the encoder 50 exceeds a certain amount, detection accuracy of the encoder 50 is considerably degraded, and therefore, the time length t between pulses in the latch signal LAT is considerably increased. Accordingly, when the time length t is larger than the threshold value Tth, it may be estimated that image quality is deteriorated when the timing of ejection of ink from the ejecting sections D is largely shifted from a regular timing. Therefore, print in degraded image quality may be suppressed by restricting ejection of ink from the ejecting sections D when the time length t is larger than the threshold value Tth.

In particular, when the ink ejected from the ejecting sections D has liquid droplets of a diameter within a range from 2 μm to 10 μm, mist of liquid droplets is likely to float without being attached to the print medium P. Accordingly, in this case, the restriction of ejection of ink from the ejecting sections D by the ejection restriction section 120 is particularly effective to suppress printing in low image quality.

Furthermore, the liquid ejecting apparatus 1 further includes the housing 10 accommodating the ejecting sections D and the encoder 50 as described above. With the configuration including the housing 10, mist of ink secondarily generated in accordance with the ejection of the ink from the ejecting sections D floats in the housing 10. Therefore, the mist of ink is likely to be attached to the scale 51 of the encoder 50. Accordingly, when the liquid ejecting apparatus 1 includes the housing 10, the restriction of ejection of ink from the ejection restriction section 120 as described above is particularly effective to suppress printing in low image quality.

Furthermore, the scale 51 includes resin material as described above. Here, when solvent ink including solvent of dissolubility for the resin material is used, it is difficult to remove the ink attached to the scale 51 by wiping or the like. Therefore, when the scale 51 and such ink are used in combination, the restriction of ejection of the ink from the ejecting sections D by the ejection restriction section 120 described above is particularly effective to suppress printing in low image quality.

Note that solvent used in the solvent ink is not particularly limited, and examples of the solvent include glycol ether series solvent and alcohol series solvent. Furthermore, the solvent ink includes, in addition to solvent, color material, resin, or the like resolved or dispersed in the solvent.

The liquid ejecting apparatus 1 further includes, as described above, the carriage 20 having the ejecting sections D, the light emitting element 53, and the light receiving elements 55*a* and 55*b* mounted thereon. Here, the movement mechanism 30 has a mechanism for moving the carriage 20. Furthermore, the encoder 50 is a linear encoder detecting a position of the carriage 20. The scale 51 of the linear encoder is long along a movement direction of the carriage 20 as described above. Therefore, it is difficult to dispose a structure for suppressing attachment of mist of ink to the scale 51. Since the mist of ink is dispersed due to air current caused by a movement of the carriage 20, the mist of ink is likely to be attached to the scale 51 in this regard. Accordingly, with the configuration including the carriage 20, the restriction of ejection of ink from the ejecting sections D by the ejection restriction section 120 is particularly effective to suppress printing in low image quality.

The measurement section 110 of this embodiment includes the oscillation circuit 112 generating a clock signal and measures the time length t using the clock signal. Therefore, measurement accuracy of the measurement section 110 may be enhanced when compared with a configuration in which the clock signal is supplied from an outside of the measurement section 110. In particular, since the oscillation circuit 112 is mounted on the head unit HU, a transmission path of the clock signal may be reduced when compared with a state in which the oscillation circuit 112 is mounted on the control module 70 or the like. Therefore, the measurement accuracy of the measurement section 110 may be appropriately enhanced.

A2. Second Embodiment

Figure 12:
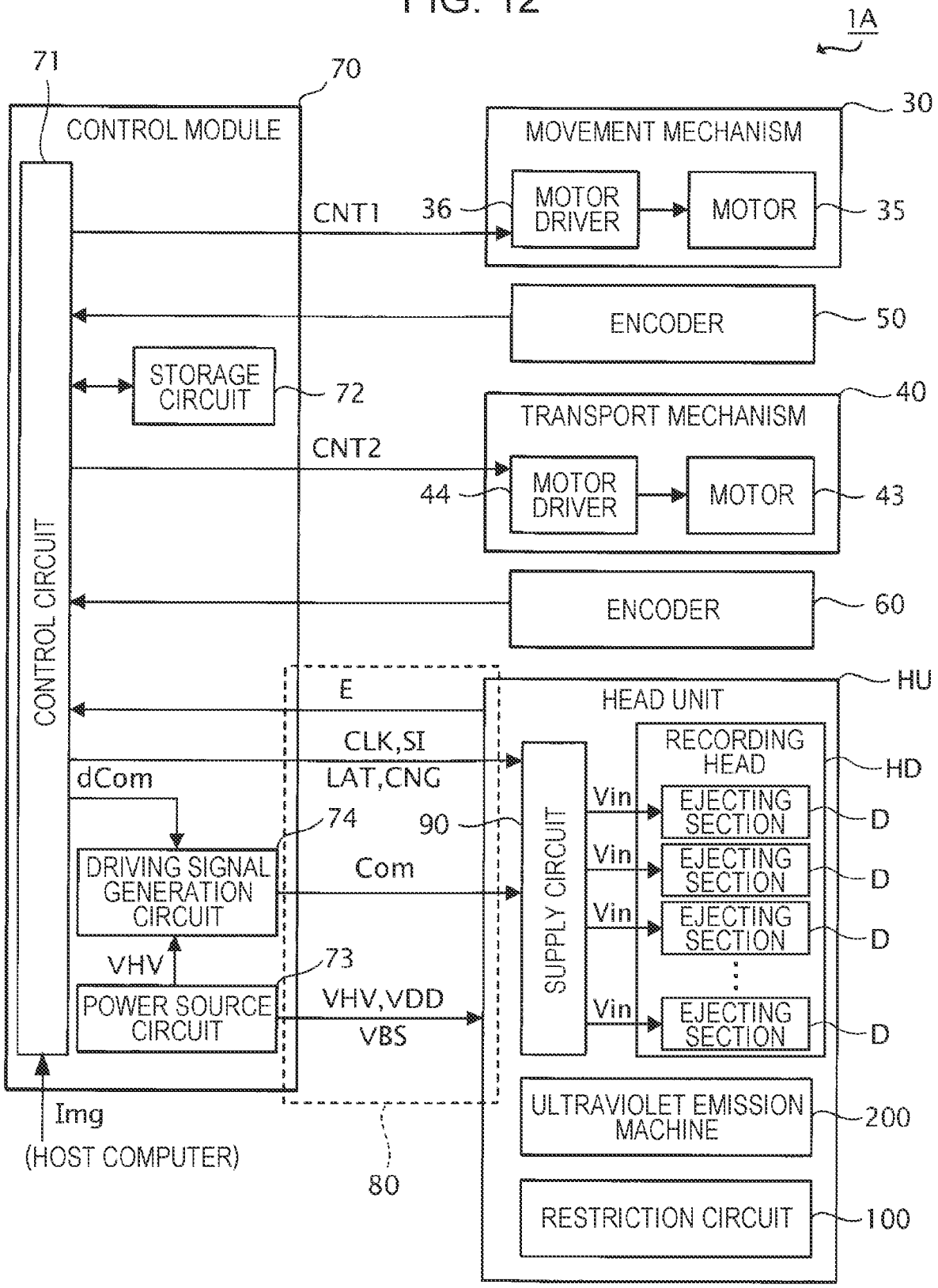
FIG. 12 is a block diagram illustrating an electrical configuration of a liquid ejecting apparatus according to a second embodiment.

FIG. 12 is a block diagram illustrating an electrical configuration of a liquid ejecting apparatus 1A according to a second embodiment. The liquid ejecting apparatus 1A uses ultraviolet curable ink. The ink includes ultraviolet curable resin or the like. The liquid ejecting apparatus 1A includes, in addition to the components of the liquid ejecting apparatus 1 described above, an ultraviolet emission machine 200.

The ultraviolet emission machine 200 emits ultraviolet rays to ink landed on the print medium P. Specifically, the ultraviolet emission machine 200 includes a light emitting element, such as a light emitting diode, not illustrated, emitting light in an ultraviolet part. In FIG. 12, the ultraviolet emission machine 200 is mounted on a head unit HU, for example. Although not illustrated, the ultraviolet emission machine 200 is arranged in a position which is parallel to ejecting sections D in a Y1 direction or a Y2 direction, for example. Note that the ultraviolet emission machine 200 may be fixed on a housing 10. In this case, the ultraviolet emission machine 200 is disposed in a position in an X1 direction relative to a movement range of a carriage 20, for example.

As described above, the ink has a ultraviolet curable property, and the liquid ejecting apparatus 1A of this embodiment further includes the ultraviolet emission machine 200 emitting ultraviolet rays to the print medium P. With this configuration, it is difficult to remove the ink attached to a scale 51 by wiping or the like. Therefore, when the scale 51 and the ink are used, the restriction of ejection of the ink from the ejecting sections D by an ejection restriction section 120 described above is particularly effective to suppress printing in low image quality.

B. Modifications

The embodiments described above are variously modified. Modifications are illustrated hereinafter in detail. Two or more embodiments arbitrarily selected from examples below may be appropriately combined as long as the embodiments are consistent with each other. Note that components having the same operations and the same functions as the embodiments in the modifications described below are denoted by reference numerals used in the foregoing description and detailed descriptions thereof are appropriately omitted.

B1. First Modification

Although the encoder 50 detecting an operation state of the movement mechanism 30 is a linear encoder in the foregoing embodiments, the encoder 50 may be a rotary encoder. In this case, the encoder 50 detects a rotation angle of the motor 35 and the control circuit 71 calculates a position of the carriage 20 based on a result of the detection performed by the encoder 50.

B2. Second Modification

Although it is assumed that the liquid ejecting apparatus is a serial printer in the foregoing embodiments and the modifications, the present disclosure is not limited to such modes, and the liquid ejecting apparatus may be a so-called line printer including a plurality of nozzles N, in the recording head HD, disposed in a range wider than a width of the print medium P.

Figure 13:
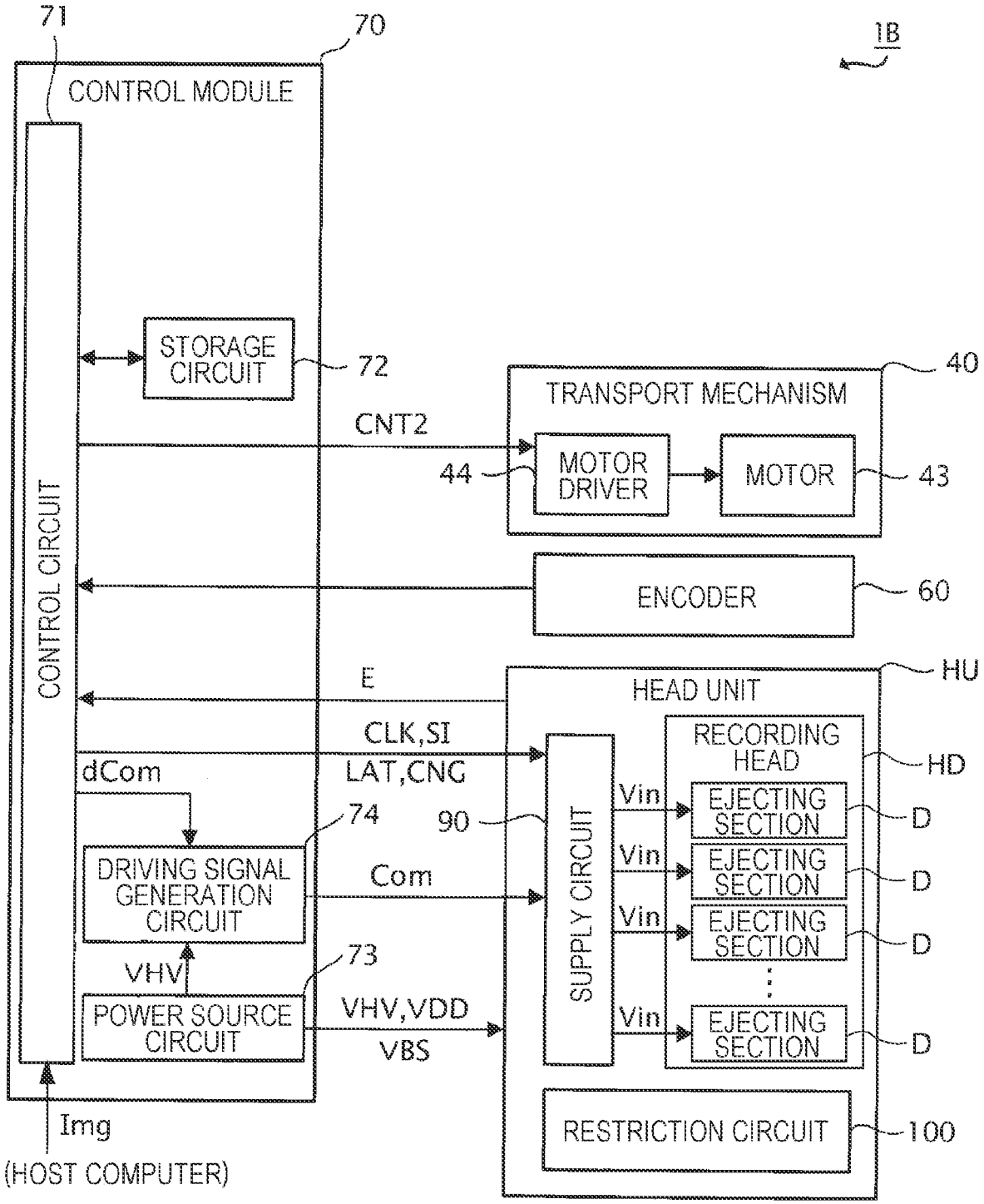
FIG. 13 is a block diagram illustrating an electrical configuration of a liquid ejecting apparatus according to a second modification.

FIG. 13 is a block diagram illustrating an electrical configuration of a liquid ejecting apparatus 1B according to a second modification. The liquid ejecting apparatus 1B is a line printer. The liquid ejecting apparatus 1B has the same configuration as the liquid ejecting apparatus 1 of the first embodiment described above except that the movement mechanism 30 is omitted. Note that a restriction circuit 100 restricts ejection of ink in a recording head HD when a detection error of an encoder 60 is detected. Furthermore, in a head unit HU, a plurality of nozzles N are disposed in a range wider than the width of the print medium P. A transport mechanism 40 in the second modification is a movement mechanism changing the relative positional relationship between the print medium P and ejecting sections D. Note that, although the transport mechanism 40 intermittently transports the print medium P in the foregoing embodiments, the transport mechanism 40 may consecutively transport the print medium P in the second modification.

Here, the encoder 60 is a rotary encoder as described above. When a scale of the encoder 60 is disposed in a space communicated with a space through which ink ejected by the ejecting sections D passes, mist of ink is likely to be attached to the scale. Therefore, a problem the same as that arises in the linear encoder in the forgoing embodiment arises. Accordingly, printing in deteriorated print quality may be suppressed by restricting ejection of ink by the recording head HD when a detection error is detected in the encoder 60.

B3. Third Modification

Although a configuration in which the control circuit 71 is a signal generation section is illustrated in the foregoing embodiments and the modifications, a configuration is not limited to this and a signal generation section may be configured by a circuit different from the control circuit 71. In this case, the signal generation section may be configured separately from a control module 70 or mounted on a carriage 20.

Figure 14:
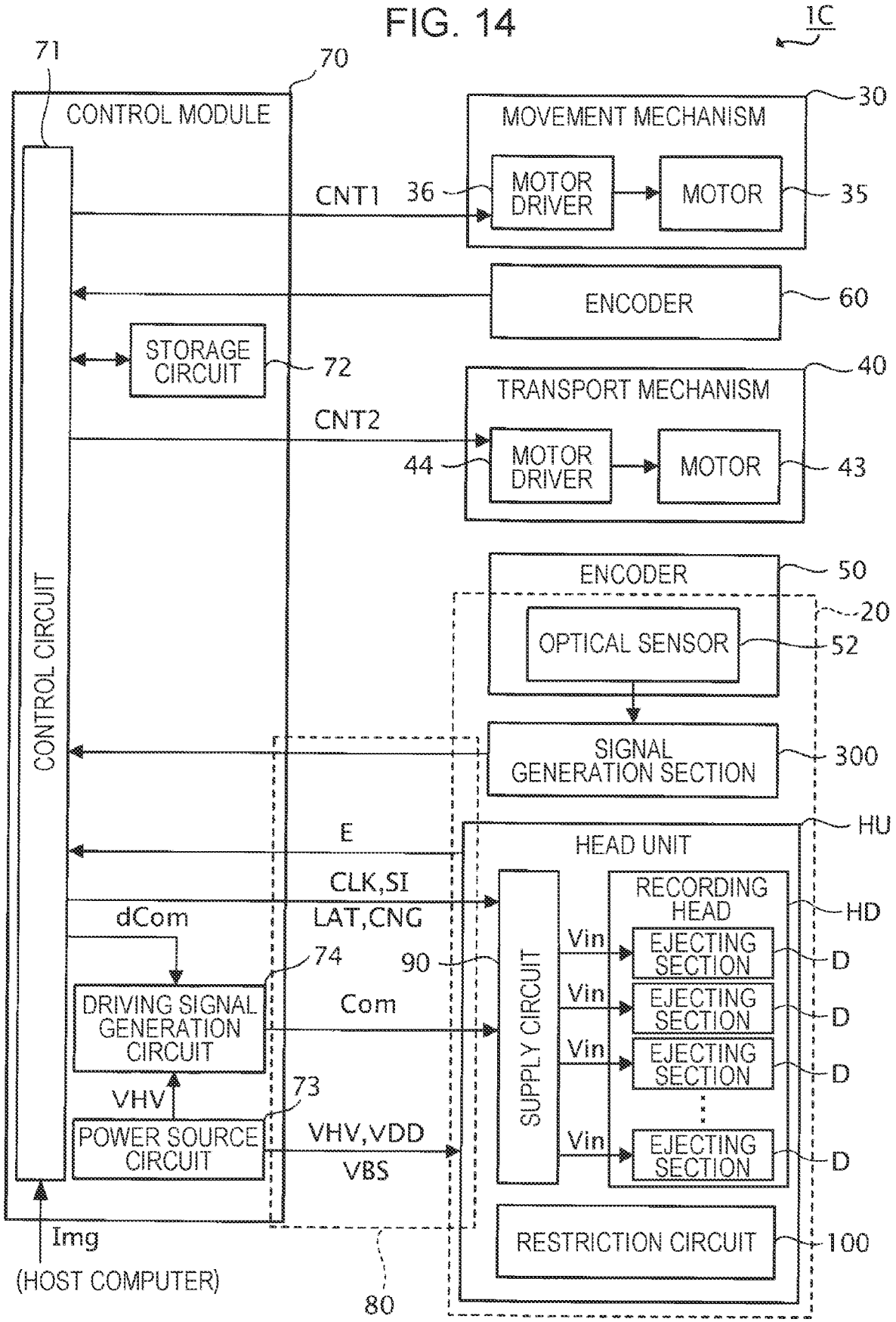
FIG. 14 is a block diagram illustrating an electrical configuration of a liquid ejecting apparatus according to a third modification.

FIG. 14 is a block diagram illustrating an electrical configuration of a liquid ejecting apparatus 1C according to a third modification. The liquid ejecting apparatus 1C has the same configuration as the liquid ejecting apparatus 1 of the first embodiment described above except that a signal generation section 300 is mounted on the carriage 20. The signal generation section 300 generates a latch signal LAT and a change signal CNG as pulse signals including pulses prescribing a timing when ejecting sections D eject ink. In an example of FIG. 14, the latch signal LAT and the change signal CNG generated by the signal generation section 300 are supplied to a head unit HU through a control circuit 71. Note that the latch signal LAT and the change signal CNG generated by the signal generation section 300 may be directly supplied to the head unit HU.

B4. Fourth Modification

Although the configuration in which the measurement section 110 measures the time length t between pulses of the latch signal LAT is illustrated in the foregoing embodiments, a pulse signal which is a target for measurement of a time length between pulses performed by a measurement section 110 is not limited to the latch signal LAT as long as the pulse signal includes a pulse prescribing the timing when ejecting sections D eject ink based on an output of an encoder 50, and the change signal CNG or other signals may be employed.

What is claimed is:

1. A liquid ejecting apparatus comprising:

an ejecting section configured to eject liquid to a print medium;

a movement mechanism configured to change the relative positional relationship between the print medium and the ejecting section;

an encoder configured to include a scale, a light emitting element emitting light to the scale, and a light receiving element receiving light reflected by the scale or light transmitted through the scale in the emitted light and configured to output information changed in accordance with a change in the positional relationship;

a signal generation section configured to generate a pulse signal including a pulse prescribing a timing when the ejecting section ejects liquid based on the information;

a measurement section configured to measure a time length between pulses included in the pulse signal; and an ejection restriction section configured to restrict ejection of liquid from the ejecting section when the time length is larger than a threshold value.

2. The liquid ejecting apparatus according to claim 1, wherein the measurement section has an oscillation circuit generating a clock signal and measures the time length using the clock signal.

3. The liquid ejecting apparatus according to claim 1, further comprising:

a housing accommodating the ejecting section and the encoder.

4. The liquid ejecting apparatus according to claim 1, wherein the scale includes resin material, and the liquid includes solvent having dissolubility for the resin material.

5. The liquid ejecting apparatus according to claim 1, further comprising:

an ultraviolet emission machine emitting ultraviolet rays to the print medium, wherein the liquid has an ultraviolet curable property.

6. The liquid ejecting apparatus according to claim 1, wherein liquid ejected by the ejecting section includes liquid droplets having a diameter in a range from 2 μm to 10 μm.

7. The liquid ejecting apparatus according to claim 1, further comprising:

a carriage including the ejecting section, the light emitting element, and the light receiving element, wherein the movement mechanism has a mechanism of moving the carriage, and the encoder is a linear encoder detecting a position of the carriage.

8. The liquid ejecting apparatus according to claim 1, wherein the encoder is a rotary encoder, and the scale is disposed in a space communicated with a space through which liquid ejected by the ejecting section passes.

9. The liquid ejecting apparatus according to claim 1, wherein when the ejection restriction section restricts ejection of liquid from the ejecting section, information on the restriction is externally output.

10. A liquid ejecting head unit mounted on a liquid ejecting apparatus including an ejecting section configured to eject liquid to a print medium, a movement mechanism configured to change the relative positional relationship between the print medium and the ejecting section, and an encoder configured to include a scale, a light emitting element emitting light to the scale, and a light receiving element which receives light reflected by the scale or light transmitted through the scale in the emitted light and configured to output information changed in accordance with a change in the positional relationship, the liquid ejecting head unit comprising:

the ejecting section;

a signal generation section configured to generate a pulse signal including a pulse prescribing a timing when the ejecting section ejects liquid based on the information;

a measurement section configured to measure a time length between pulses included in the pulse signal; and an ejection restriction section configured to restrict ejection of liquid from the ejecting section when the time length is larger than a threshold value.

11. The liquid ejecting head unit according to claim 10, wherein the liquid includes solvent having dissolubility for resin material.

12. The liquid ejecting head unit according to claim 10, wherein the liquid has an ultraviolet curable property.

13. A liquid ejecting head unit according to claim 10, wherein liquid ejected by the ejecting section includes liquid droplets having a diameter in a range from 2 μm to 10 μm.

14. The liquid ejecting head unit according to claim 10, wherein when the ejection restriction section restricts ejection of liquid from the ejecting section, information on the restriction is externally output.

* * * * *